US006764269B1

(12) United States Patent
Cannata

(10) Patent No.: US 6,764,269 B1
(45) Date of Patent: Jul. 20, 2004

(54) FRAME APPARATUS MOUNTABLE ON A FORKLIFT

(75) Inventor: Anthony J. Cannata, 7723 Hwy. 182 East, Morgan City, LA (US) 70381

(73) Assignee: Anthony J. Cannata, Morgan City, LA (US)

( * ) Notice: Subject to any disclaimer, the term of this patent is extended or adjusted under 35 U.S.C. 154(b) by 0 days.

(21) Appl. No.: 10/357,890

(22) Filed: Feb. 4, 2003

(51) Int. Cl.[7] ..... B66C 3/00
(52) U.S. Cl. ..... 414/607; 414/785
(58) Field of Search ..... 414/607, 785

(56) References Cited

U.S. PATENT DOCUMENTS 3,283,933 A * 11/1966 Vander Wal ..... 414/607
3,788,507 A * 1/1974 Voss ..... 414/607
3,971,485 A * 7/1976 Hoppey ..... 414/420
4,405,278 A * 9/1983 Kvalheim ..... 414/411
4,408,946 A * 10/1983 Haven et al. ..... 414/424
4,529,345 A 7/1985 Van Gompel
4,579,501 A 4/1986 Fox
4,720,232 A * 1/1988 Williams ..... 414/607
4,799,840 A 1/1989 Van Gompel et al.
4,890,973 A 1/1990 Frison et al.
5,078,415 A 1/1992 Goral
5,385,233 A 1/1995 McKibben et al.
5,417,536 A 5/1995 Cech
5,433,493 A * 7/1995 Dix et al. ..... 294/104
5,496,147 A * 3/1996 Taube ..... 414/607
5,573,066 A * 11/1996 Vaillancourt et al. ..... 169/49
5,692,583 A * 12/1997 Reed et al. ..... 187/237
5,906,165 A * 5/1999 McCorkle et al. ..... 108/55.1
6,305,566 B1 10/2001 Pigott et al.
D459,365 S * 6/2002 Myers et al. ..... D15/19

* cited by examiner

*Primary Examiner*—Richard Ridley
(74) *Attorney, Agent, or Firm*—Garvey, Smith, Nehrbass & Doody, LLC; Gregory C. Smith

(57) ABSTRACT

A frame apparatus which is positionable on the tines of a forklift which includes a pair of lower feet portion, having an upper flat surface, and having an opening therethrough in which the forklift tines remain fully inserted therein so that the frame work is fully positioned on the tines of the forklift. There is further included a rear wall portion, which rests against the forklift which can be secured thereto. Further there is provided a pair of sidewalls extending a distance out from the rear wall, in parallel relation to the pair of foot members, so as to define a first large opening into which a load such as a drum or container may be placed, first and second bar members positioned between the rear portion and each of the wall members, which when in a first down position, define a small opening therebetween to accommodate a smaller container, and when in a second up position define the larger space to accommodate the larger container between the wall members. In either size container, the container is positioned upon the feet member and between the side walls to avoid lateral movement of the drum or container thereon.

11 Claims, 5 Drawing Sheets

FRAME APPARATUS MOUNTABLE ON A FORKLIFT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to forklifts. More particularly, the present invention relates to a frame which is mountable on the tines of the forklift in order to assure that the forklift load does not inadvertently fall from the forklift as it is being moved about.

2. General Background of the Invention

It is quite commonly known in warehousing and other fields, that the use of a forklift in order to transport goods is universal. Forklifts, in their known operation, include a pair of feet or tines, which extend from the front of the forklift, and move in both upward and downward and lateral positions, upon which loads such as boxes or tanks or drums of material are lifted in order to move them from one location to the other. One of the drawbacks of a forklift is the fact that the tines are simply two feet which extend from the forklift, and include no additional sidewalls or means for insuring that the load which is positioned on the tines of the forklift does not inadvertently topple from the tines as the load is being moved. This can be particularly hazardous in the event that a drum of, for example, hazardous material or volatile material is moved from a location and has to be lifted to a rather great height in order to place the load for storage. If the load becomes unstable or unbalanced, it is not uncommon that the load, such as a container, known as the IBC-stainless steel tote (s.s. tote), which are 550 gallons in size or smaller and universally used. These containers external dimensions are 42"×48". And, because of these dimensions, may tumble from the tines of the forklift and cause serious damage or worse, serious injuries to the worker or someone below the load.

Therefore, there is a need in the industry for a device which can be retrofitted or accommodated by a forklift, which would provide a more stable frame in which a load such as a s.s. tote or a quantity of hazardous material can be placed so as to allow the operator of a forklift to move the load quite easily without fear of the load becoming unbalanced and falling off of the forklift tines. In a search conducted on the patentability of the apparatus, there were several patents which were pertinent to the present invention, and which have been included in the information disclosure statement submitted herewith.

BRIEF SUMMARY OF THE INVENTION

The apparatus of the present invention solves the shortcomings in the art in a simple and straightforward manner. What is provided is a frame apparatus which is positionable on the tines of a forklift which includes a pair of lower feet portion, having an upper flat surface, and having an opening therethrough in which the forklift tines remain fully inserted therein so that the frame work is fully positioned on the tines of the forklift. There is further included a rear wall portion, which rests against the forklift which can be secured thereto. Further there is provided a pair of sidewalls extending a distance out from the rear wall, in parallel relation to the pair of foot members, so as to define a first opening into which a load such as a drum or container may be placed, and when positioned upon the feet member and between the side walls avoids lateral movement of the drum or container thereon. There is also provided first and second bars related to the side walls which define a second, more narrow opening between the bars for accommodating a second narrower container.

Therefore, it is a primary object of the present invention to provide an apparatus which can be retrofitted onto an existing forklift, for allowing material stored in drums or other containers to avoid lateral movement and falling from the forklift;

It is a further object of the present invention to provide an apparatus which may be utilized by a forklift operator very quickly by inserting the tines into the feet members of the apparatus and providing a stable frame work upon which a load such as s.s. tote of oil or the like may be placed;

It is a further object of the present invention to provide an apparatus which when positioned on the tines of the forklift defines an area which is confined by sidewalls and a floor portion, which provides a very stable and confined area in which a load can be carried on a forklift without the fear of the load tumbling from the forklift.

It is a further object of the present invention to provide an apparatus which when positioned on the tines of a forklift defines a first area confined by the sidewalls and a floor portion for receiving a container therein in a very stable and confined area, and also provides a second more narrow area which would accommodate a smaller container therein so as to maintain the smaller container very stable without fear of the load tumbling from the forklift.

It is a further object of the present invention to prevent damage to the protection plate behind the drain valve at the bottom of the s.s. tote container when moving about from the 48" dimension size.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

FIGS. 1 through 7 illustrate the preferred embodiment of the apparatus of the present invention as illustrated by the numeral 10. Before a discussion of the apparatus 10, it should be noted that in general the apparatus is designed to be used with a forklift to transport tanks which have a general dimension of 48 inches wide by 42 inches deep, although other types of containers may be transported with the apparatus 10. These tank dimensions will be important as will be described further.

Figure 1:
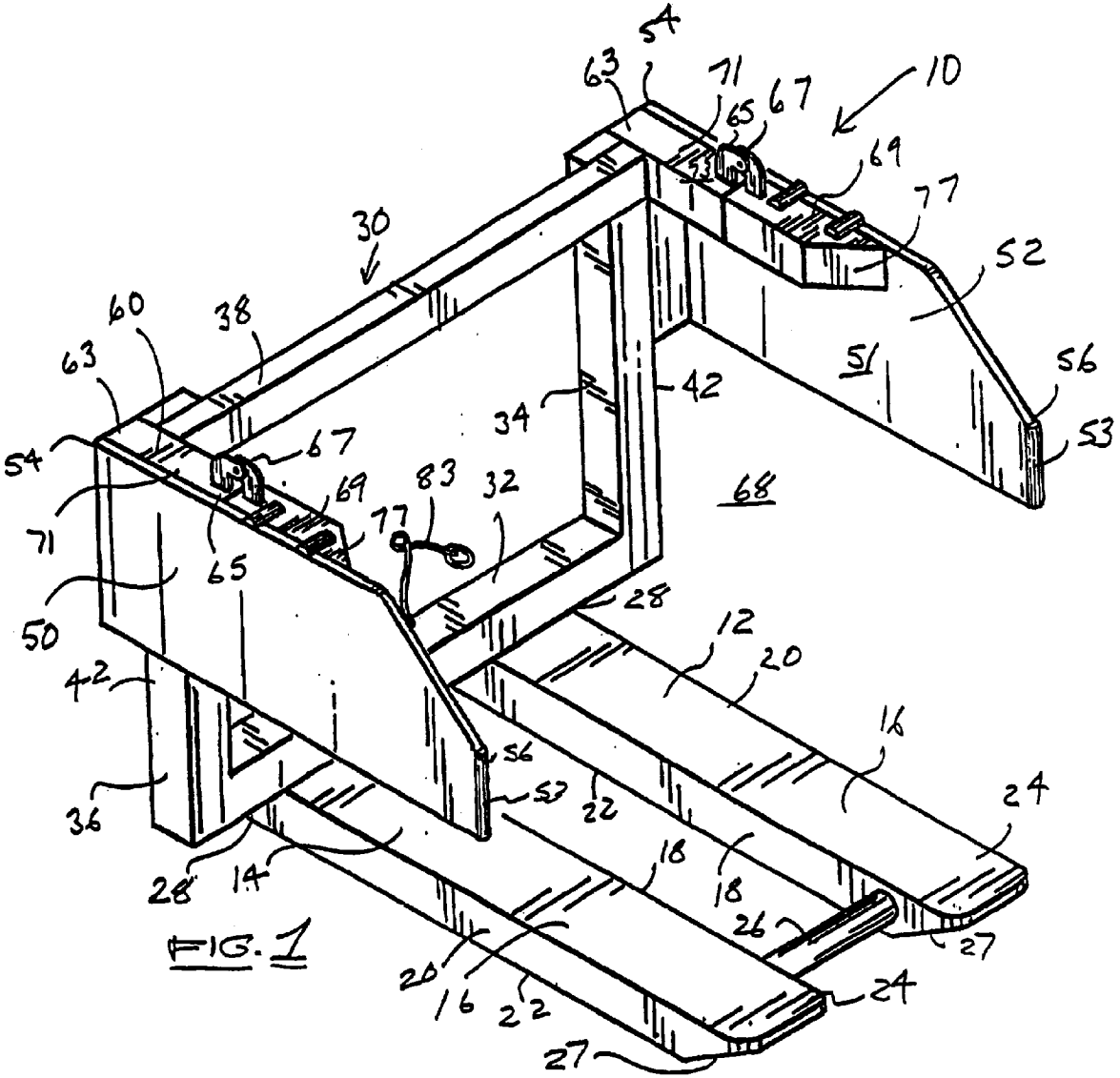
FIG. 1 illustrates an overall view of the preferred embodiment of the apparatus of the present invention in a first configuration.
Figure 2:
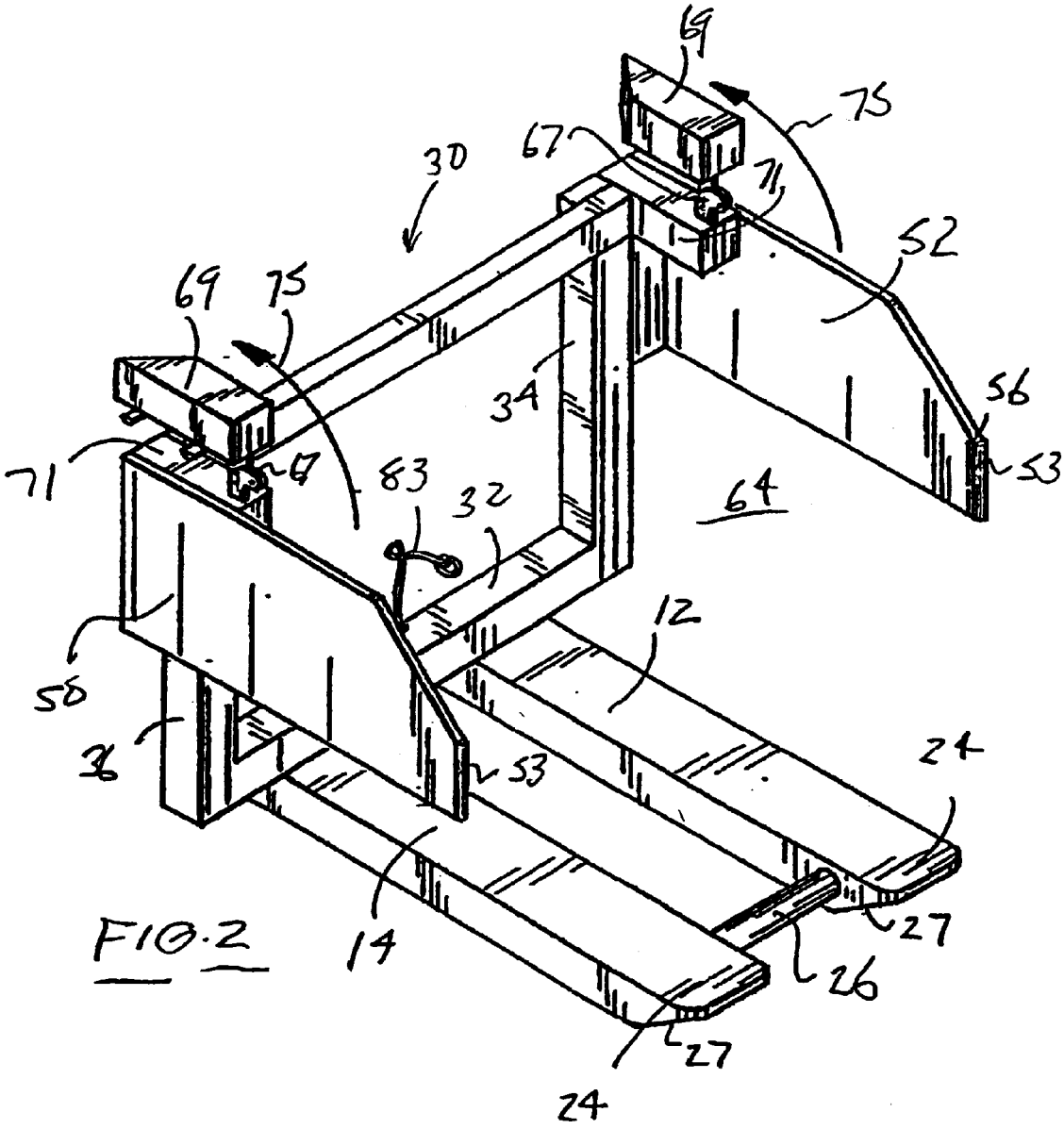
FIG. 2 illustrates an overall view of the preferred embodiment of the apparatus of the present invention in a second configuration.

As illustrated in overall view in FIGS. 1 and 2, apparatus 10 is illustrated having a pair of parallel foot portions 12, 14. Each of the foot portions include a flat upper surface 16 and a pair of side walls 18 and 20 and an underside 22 defining the two foot members 12, 14. Each of the members 12 and 14 included are spaced at a distance which is equal to the normal distance of separation of the tines of a forklift as will be explained more fully. The forward ends 24 of each of the foot members 12, 14 are held in relation via a spacing bar 26. Each of the foot members 12, 14 have an angulated under surface 27 on their forward most ends in order to allow easy insertion or easy movement of the feet in the positioning onto a pallet or the like as will be described further.

Further the rear end 28 of each of the foot members 12, 14 are secured to a rear frame 30 which is defined by a lower transverse frame member 32, a pair of upright frame members 34, 36 and an upper transverse frame member 38 to define basically the rectangular frame 30 defining an opening 40 between the various members.

There is further provided on each edge 42 of each of he upright members 34, 36 a first sidewall 50 and a second sidewall 52. Each of the sidewalls 50 and 52 extend from a rear edge 54 which is substantially flush with the rear wall of the upper transverse frame member 38, to a forward point 56. As seen in the figure, each of the sidewalls 50, 52 extend out a distance substantially the distance of the feet members 12, 14 although it may be slightly less distance than the actual length of the foot members 12, 14. Preferably, the inner surfaces 51 of each of the side walls 50, 52 would be 48 inches apart defining a space 64 therebetween so as to accommodate a container when the container is placed into the apparatus between the sidewalls 50, 52, in a position that the walls 48 inches in width extend across the sidewalls 50, 52.

As further seen in FIGS. 1 and 2, there is provided a rectangular bars 60, 62 extending outward from the frame 30, secured between the outer edge of the frame 30 and the inner surface 51 of each of the sidewalls 50, 52, and a distance along the side walls 50, 52. Although the bars 60, 62 are secured stationary at their rear ends 63, substantially along the midsection 65 of each of the bars, the bars are discontinuous, and the forward portion 69 and rear portion 71 are held in place to define the continuous bars 60, 62, via a hinge 67, along the top surface 73 of the bars 60, 62. As illustrated in FIG. 2, this feature allows the forward portion 69 to rotate upward in the direction of arrow 75 and rest above the rear portion 71.

Figure 3:
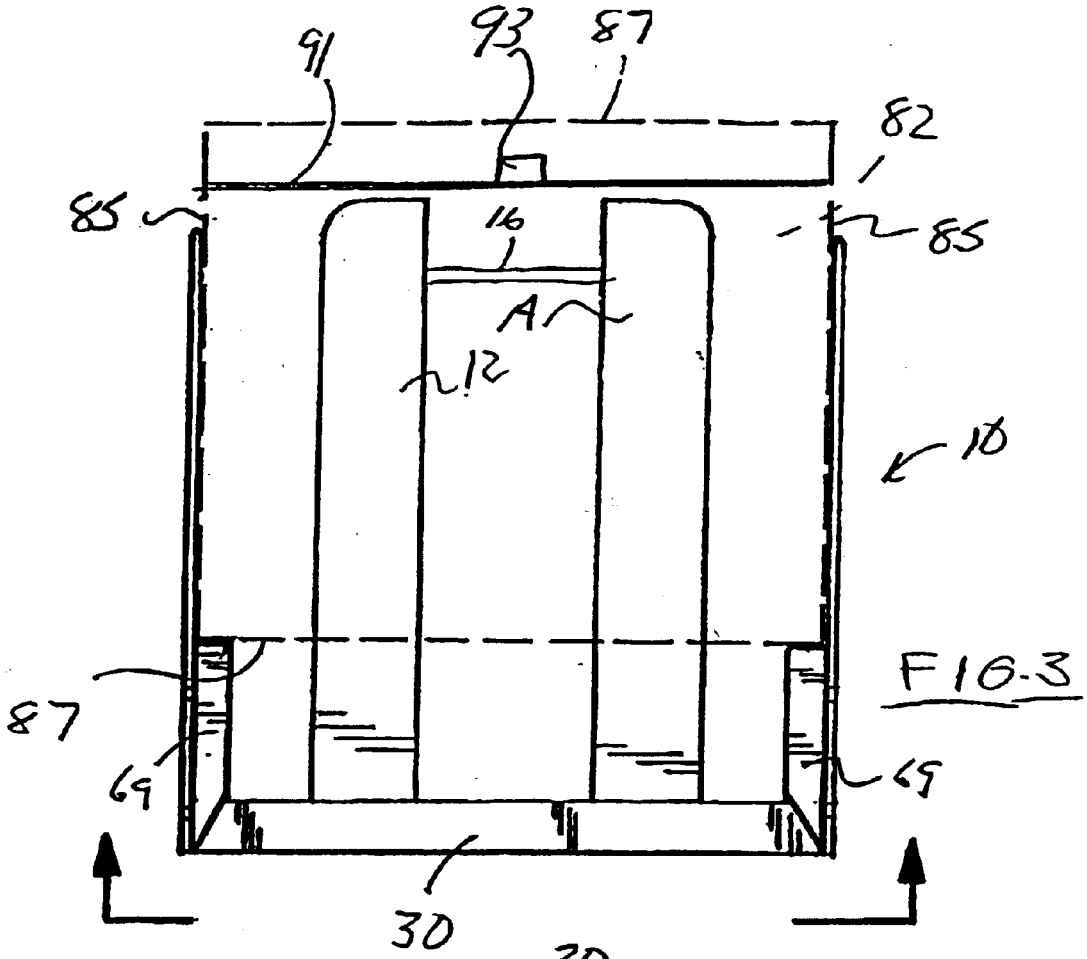
FIG. 3 illustrates a top view of the apparatus of the present invention in the first configuration.

In this position, the apparatus 10 is able to receive a container 48 inches in width between the sidewalls 50, 52 as illustrated in top view in FIG. 3. When a container 42 inches is to be lifted, the forward portions 69 of each bar 60, 62, is rotated back to the normal position, as seen in FIG. 1, and in top view in FIG. 4, and there is defined a smaller opening 68, 42 inches wide, between the two bars 60, 62 into which a container may be secured. It should be noted that the forward ends 77 of each of the bars 60, 62, when in the down position are angulated so as to allow a container to avoid be impacted by a flat end, and will slide along the angulated ends 77 of each bar 60, 62. Likewise, when a container 48 inches wide is being received, the forward edge 56 of each of the sidewalls 50, 52 include a rounded end 53, which may be a round bar welded thereto, so that when a container of the type as will be explained further, is placed in the opening 64 between the two side members 50, 52, that the container will slide therein quite easily instead of making direct contact with the forward edge 56 of the frame member.

The ability of the bars 60, 62 to rotate between a first and second positions is important in accommodating the storage tank in question. Before describing the manner in which the tanks are received by the apparatus, reference is made to FIG. 5, which illustrates a typical tank 82 of the type to be conveyed by the apparatus. Such a tank would be of a pair of opposing sidewalls 85, 42 inches deep, and a second pair of opposing sidewalls 87, 48 inches deep, with a plurality of feet 88 at each corner, defining a space 89 which allows the tines of a forklift to engage the tank 82. However, it is critical to note that in the configuration where the tank is placed on the apparatus along its walls 85, 42 inches deep, as seen in FIG. 3, there is provided a protective plate 91, along the bottom of the tank which protects a drain valve 93 from damage by the foot members 12, 14 of the apparatus 10, or for that matter, of fork lift tines 74. However, when the tank wall 85 makes contact with the rear bars 71, the tank cannot be engaged any further on the apparatus, and the feet members 12, 14, do not contact the protective plate 91 or damage the valve 93.

Figure 4:
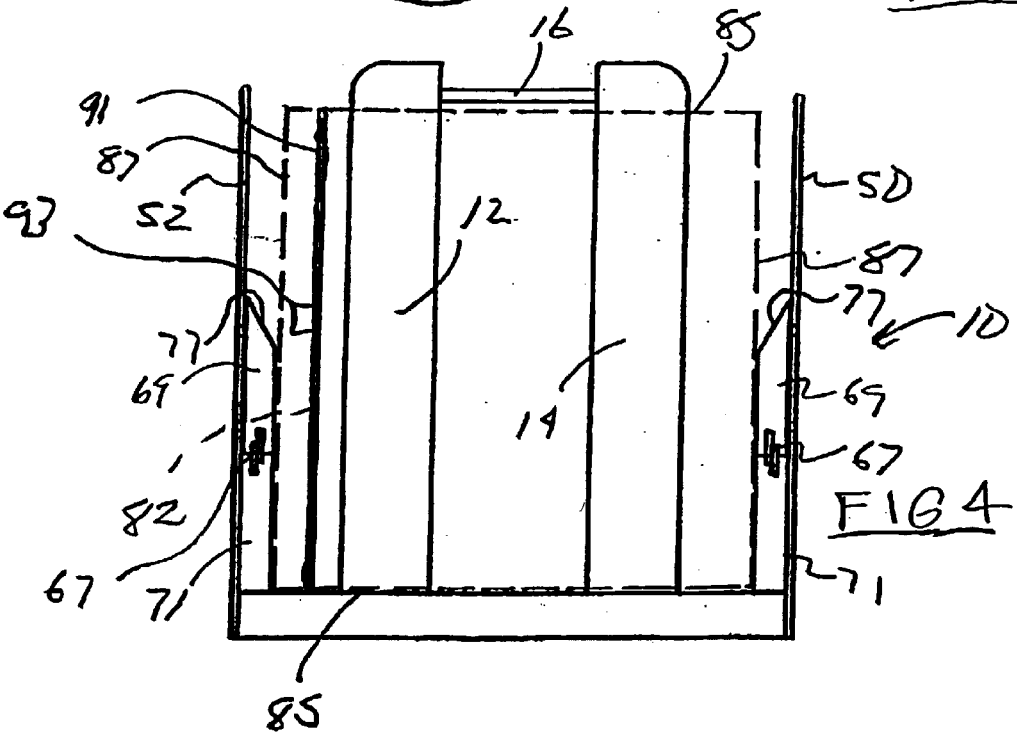
FIG. 4 illustrate a top view of the apparatus of the present invention in the second configuration.

As seen in FIG. 4, when the tank is placed on the apparatus with its walls 87, 48 inch width, the tank is engaged to the very rear of the opening between the bars 60, 62, and since there is no protective plate 91 along those walls for the ends of the feet 12, 14 to encounter, the feet would slide past the end of the tank.

Figure 5:
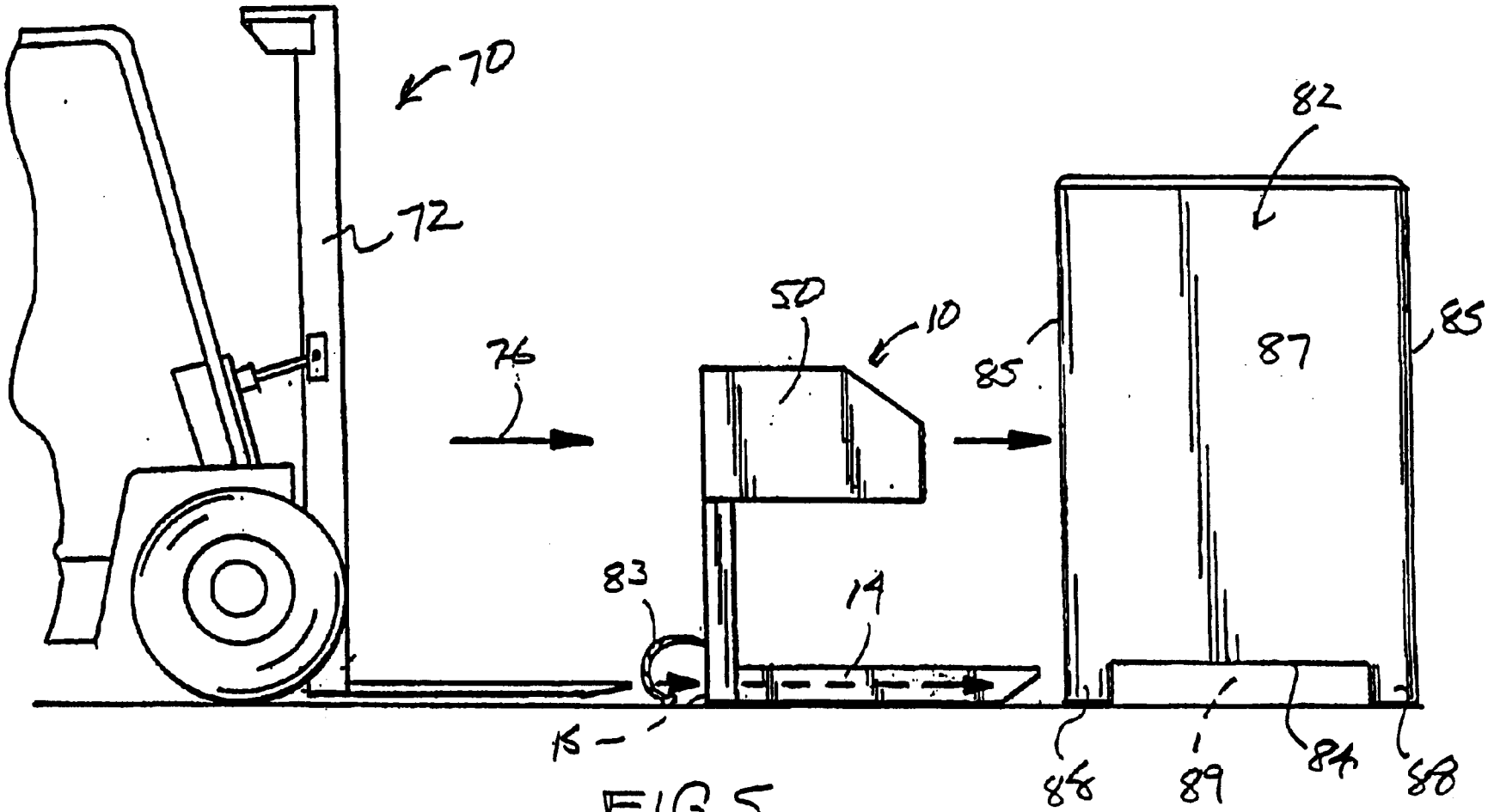
FIG. 5 illustrates a side view of the apparatus with it being accommodated onto a forklift.

Turning now again to FIG. 5, there is illustrated in the side view of the apparatus 10 which illustrated in the side view foot member 14 and the upper sidewall member 50 and the upper frame 36. As is illustrated, there is a forklift 70, having a standard upright operational member 72 with tines 74 extending outward from the bottom of the frame 72 which is very standard in the industry. As illustrated the forklifts 70 would move in the direction of arrow 76, wherein the ends 78 of the tines would be inserted into the opening 15 of each of the foot members 12, 14 of apparatus 10 so that the entire length of tines 74 would be fully inserted into the opening 15 of each of the foot members 12, 14, so that when inserted the apparatus would be in the position as seen in FIG. 5. Once the apparatus has been inserted on the forklift as seen in FIG. 5, there is included a flexible member 83 such as a chain or rope or the like which may be engaged between the frame 30 and the forklift frame 72, so that should the forklift tines inadvertently move to a position less than vertical, that the frame does not disengage from the forklift by simply sliding off of the forklift. In this manner the flexible member 83 would maintain the frame on the forklift 70 and not allow it to slide therefrom. As seen in FIG. 3, the bars 60, 62 are in their first configuration as seen in FIG. 1, therefore defining the smaller space 68, a space of 42 inches in width, to house a smaller container 82, between the bars 60, 62.

Figure 6:
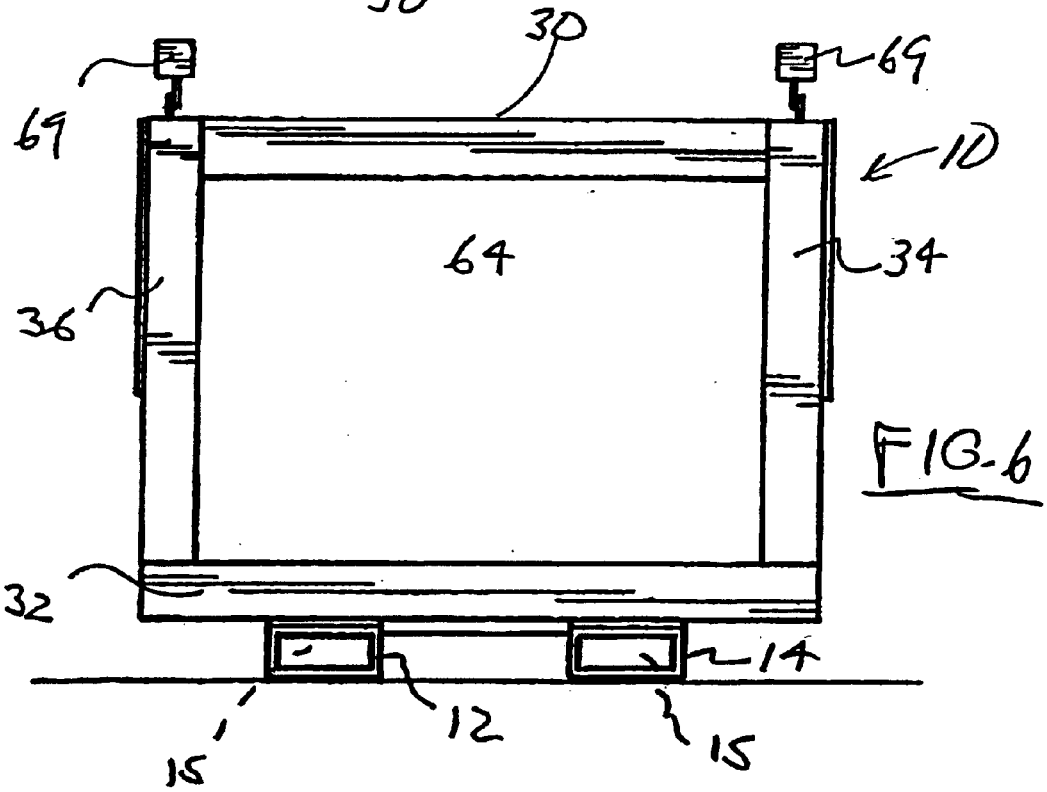
FIG. 6 illustrates a rear view of the apparatus of the present invention.

As seen in FIG. 6, the openings 15 are clearly seen thorough the rear view of each of the foot members 12, 14, and as illustrated again, as stated earlier, each of the tines 74 would engage into each of the openings 15 so that the apparatus then is fully engaged into the tines as seen in FIG.

5. In this configuration, also seen in top view in FIG. 4, there is illustrated the forward portions 69 of the bars 60, 62 rotated upward, therefore the apparatus is able to accommodate a 48 inch wide container 82 in space 64.

Figure 7:
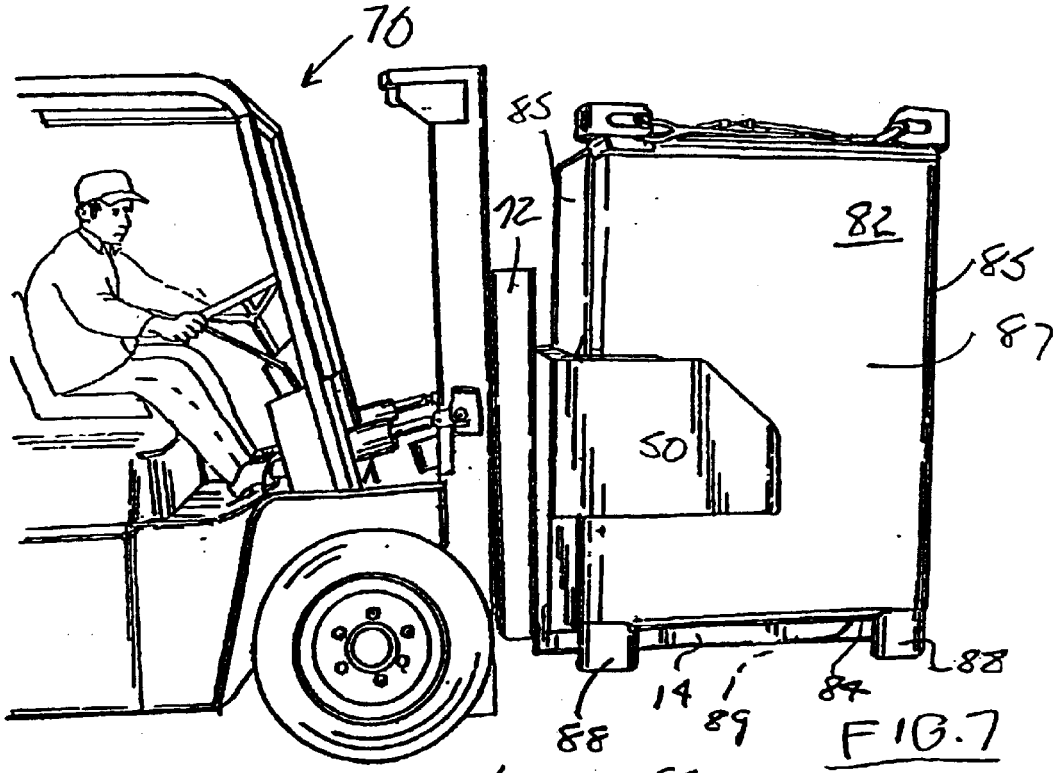
FIG. 7 illustrates an overall view of the apparatus positioned on a forklift carrying a particular container of material.

Turning finally to FIG. 7, again there is illustrated the forklift 70 where the apparatus 10 has been placed with the foot members 12,14 having been fully engaged by the tines 74 of the forklift 70. As illustrated, there is a container 82 which is being supported on its lower floor portion 84 on the upper surface 16 of each of the members 12, 14, so that it is resting thereupon. In the position as seen in FIG. 7, there is illustrated one of the sidewalls 50 engaging the sidewall 87 of the container 82 and likewise although it is not illustrated the second wall 52 would likewise be engaging the second upright sidewall 87 of the container 82 so as to hold it in place while it is being conveyed to a position for storage. As illustrated in FIG. 7, it is clearly seen that should the operator of the forklift 70 lose control of the lift and make a sudden turn or the like and the container would shift, if the apparatus 10 were not in place the container 82 may simply topple off of the forklift tines and cause serious damage to the container or worse.

As seen in FIG. 3 in the case of a 48 inch wide container, and in FIG. 4, in the case of a 42 inch container, in either case, as long as the operator maintains the forklift tines in a slightly upright position which is normally done in the operation of a forklift, there will be no opportunity for the container 82 to topple sideways off of the forklift and therefore is secured within opening 64 as was defined by sidewalls 50, 52, or opening 65, as defined by bars 60, 62, as seen in FIGS. 1 and 2.

For purposes of construction, the two feet 12, 14 of the apparatus as seen in FIG. 1 as a first configuration and FIG. 2 as a second configuration are of a sufficient length to accommodate the tines 74 of the forklift 70, in order to support the apparatus thereupon.

Parts List

The following is a list of suitable parts and materials for the various elements of the preferred embodiment of the present invention.

Parts list apparatus 10
foot portions 12, 14
openings 15
flat upper surface 16
sidewalls 18, 20
underside 22
forward ends 24
spacing bar 26
angulated under surface 27
rear end 28
rear frame 30
lower transverse frame member 32
upright frame members 34, 36
upper transverse frame member 38
edge 42
sidewalls 50, 52
inner surface 51
ends 53
rear edge 54
forward point 56
rectangular bars 60,62
rear end 63
opening 64
midsection 65
hinge 67
opening 68
forward portion 69
fork lift 70
rear portion 71
operational members 72
top surface 73
tines 74
arrows 75
arrows 76
forward end 77
ends 78
container 82
flexible member 83
floor portion 84
side walls 85
side walls 87
feet 88
space 89
protective plate 91
drain valve 93

The foregoing embodiments are presented by way of example only; the scope of the present invention is to be limited only by the following claims.

What is claimed is:

1. A frame mountable on a forklift, comprising:

a. a base portion, having first and second feet members, the members having openings therethrough and spaced apart to accommodate the tines of a forklift into the openings;

b. a rear portion positioned against the forklift when the tines are inserted into the openings;

c. a first and second wall members extending from the rear portion and defining a first opening therebetween for accommodating containers resting on the base portion and secured in place between the first and second wall members; and d. bar members positioned between the rear portion of each of the wall members which when in a first down position, define a space therebetween to accommodate a smaller width container, and when in a second up position, define a larger space to accommodate a larger width container between the wall members.

2. The apparatus in claim 1, further comprising a member for securing the frame to the forklift when the frame is engaged thereupon.

3. The apparatus in claim 1, wherein the frame can be accommodated onto any conventional forklift.

4. The apparatus in claim 1, wherein the first and second wall members extend sufficiently out from the rear portion so as to prevent a container from falling off the side of the frame when the container is supported on the base portion of the frame.

5. A frame apparatus in combination with a forklift, the combination comprising:

a. a forklift of the type having tines extending outward therefrom;

b. a frame engagable by the tines of the forklift, the frame comprising:

1. a base portion, having first and second feet members, the members having openings therethrough and spaced apart to accommodate the tines of a forklift into the openings;

2. a rear portion positioned against the forklift when the tines are inserted into the openings;

3. first and second wall members extending from the rear portion and defining an opening therebetween for accommodating a large container resting on the base portion and secured in place between the first and second wall members; and 4. first and second bar members positioned between the rear portion of each of the wall members, which when in a first down position, define a space therebetween to accommodate a smaller container, and when in a second up position define a larger space to accommodate the larger container between the wall members.

6. A frame mountable on a forklift, comprising:

a. a base portion, having first and second feet members, the members having openings therethrough and spaced apart to accommodate the tines of a forklift into the openings;

b. a rear portion positioned against the forklift when the tines are inserted into the openings;

c. a first and second wall members extending from the rear portion and defining a first large opening therebetween for accommodating large containers resting on the base portion and secured in place between the first and second wall members; and d. first and second bar members positioned between the rear portion of each of the wall members, which when in a first down position, define a small opening therebetween to accommodate a smaller container, and when in a second up position define a larger space to accommodate the larger container between the wall members.

7. The apparatus in claim 6, wherein the first and second bar members each include a hinge along their length so as to provide a means for a forward portion of the bar to rotate and rest on the rear portion of the bar, so that a larger container can be placed between the wall portions.

8. The apparatus in claim 6, wherein the opening between the wall portions is approximately 48 inches and the opening between the bar members when in the down position measures approximately 42 inches.

9. The apparatus in claim 6, further comprising a member for securing the frame to the forklift when the frame is engaged thereupon.

10. The apparatus in claim 6, wherein the frame can be accommodated onto any conventional forklift.

11. The apparatus in claim 6, wherein when the bars are in the second up position, the container is positioned to make contact with a face of the rear bar, so as to prevent the container from sliding further back to avoid damage to a structure along the bottom of the container.

* * * * *